United States Patent [19]

Smith

[11] Patent Number: 4,497,424

[45] Date of Patent: Feb. 5, 1985

[54] ELASTIC HOSIERY APPLICATOR

[76] Inventor: Samuel W. Smith, 1104 Burbank Rd., Anthony, Fla. 32617

[21] Appl. No.: 272,686

[22] Filed: Jun. 11, 1981

[51] Int. Cl.[3] ..... A47J 51/06

[52] U.S. Cl. ..... 223/111

[58] Field of Search ..... 223/111, 112; 70/456 R, 70/459; 63/6, 15.1, 15.7; 273/158; 211/132, 130

[56] References Cited

U.S. PATENT DOCUMENTS 3,227,335 1/1966 Minnema et al. ..... 223/111
3,619,913 11/1971 Albrecht ..... 63/15.7
3,853,252 12/1974 Scianimanico ..... 223/111
4,130,226 12/1978 Farrel ..... 223/111
4,238,061 12/1980 Marchetti et al. ..... 223/111

*Primary Examiner*—Henry S. Jaudon
*Assistant Examiner*—J. L. Kravitz

[57] ABSTRACT

A device for accumulating, dilating, and stabilizing the body of an elastic hose and applying same to the lower leg of a person. A sized circlet of round wire has four equidistantly spaced descending "legs", each of which is U-shaped and has an outwardly projected and rounded tip portion. The device is smoothly finished and chrome plated overall.

5 Claims, 14 Drawing Figures

ELASTIC HOSIERY APPLICATOR

BACKGROUND OF THE INVENTION

1. Field of the Invention

The invention relates generally to devices for use by the handicapped and by health care workers to facilitate the application of elastic hosiery upon the lower leg of a person. More particularly, the invention relates to an extremely simple collecting frame upon which the body of an elastic hose may be accumulated into a stabilized, dilated, and easily manipulatable configuration; even more particularly, the invention relates to such a device which may be readily drawn up the lower leg of a person during the application of such hosiery, and easily removed thereafter.

2. Description of Prior Art

In the past, the application of elastic hosiery upon the lower leg of a person, particularly support hosiery of the sort sold under the brand name SUP-HOSE, has been a relatively tedious task, requiring considerable time and considerable hand and arm strength. Such hosiery is often prescribed for elderly persons in the treatment of varicose vein conditions, and because of the extreme elasticity of such hosiery, it has often been impossible for persons of arthritic, obese, or similar infirm condition to fit such hosiery upon themselves, or to remove such hosiery if fitted by another. Such an inability is more than a mere inconvenience, as it imposes an actual helplessness and engenders an acute sense of dependence and infirmity even in cases of marginal handicap, as when the individual is quite able to 'do for themselves' otherwise.

This problem is especially acute for persons who live alone, travel alone, or otherwise have limited access to personal assistance.

Moreover, owing to the extreme elasticity of such hosiery, health care workers who may be required to fit such hosiery upon their charges often experience difficulty in doing so. Even normal hand and arm strength may well be taxed when fitting one or more pairs of such hosiery, especially upon supine patients who are unable to offer assistance.

Additionally, varicose vein conditions often produce localized areas of extreme and persistant soreness on the surface of the human leg. The hands of a health care worker, especially the knuckles, have heretofore been prone to pressing upon or abrading such areas of soreness during the application of elastic hosiery, to the extreme discomfort of the patient.

In the past, the recommended method of applying elastic hosiery has involved turning the hosiery inside out, then positioning the toe portion of the elastic hosiery against the toes of the human foot and thereafter working the elastic hosiery up the human foot and leg and into position simultaneous to turning the elastic hosiery right side out. This method is difficult and time consuming at best, as it requires considerable hand strength, especially finger strength, and because it is rather difficult to ascertain the proper orientation of the foot portion of the hosiery relative to the human foot, and to maintain such orientation during the process of application. Also, considerable and extended body flexion is required of persons attempting to fit such hosiery upon themselves by the aforementioned method.

In common practice, a method of application is often adopted which involves rolling the hosiery up into a doughnut shape, and thereafter donning the elastic hosiery in the manner of an ordinary sock. This process is disadvantageous in that it requires a maximum of hand and arm strength to initially dilate and thereafter maintain the dilation of the totality of the elastic hosiery material. It is also difficult to apply elastic hosiery by this method to the leg of another person, especially if they are in a supine position. In so doing, such a person's leg must usually be raised several inches aloft, and suspended during the application process against rather vigorous pushing and pressure. The knee of an arthritic patient may be harmed by hyperextension during such a process.

Also, as the ankle of the patient must usually be slung in hammock fashion in a loop of the hosiery material, and the loop of hosiery material must then be drawn along the length of the patient's lower leg, surface conditions of the skin are easily excaberated, especially in the area of the calf of the leg.

Heretofore the known methods of applying elastic hosiery have been less than satisfactory, taxing to even normal hand and arm strength, and often entirely beyond the abilities of persons of arthritic or infirm character. Therefore, the need has arisen for a means and device whereby a health care worker may quickly and easily fit such hosiery upon the lower legs of one or more of their charges successively, without distress to any party, and means whereby a person of moderate disability such as an elderly, infirm, obese, or arthritic individual may successfully fit and remove such hosiery at will.

Such a device should be simple and durable in use, compact, readily portable in coat pocket or purse, and harmless to the fabric of elastic hosiery; such a device should also be noninjurious to humans in every reasonable circumstance of use or misuse. Such a device should be inexpensive to manufacture, and be manufactureable from common materials and by conventional processes. Such a device should employ principles of usage which are easily effected, easily instructed, and easily understood. Such a device should be manufactureable in unit construction to employ no moving parts, and alternativly, should be also manufactureable in hinged, folding, collapseable, or breakaway versions which employ few and simple moving parts and which attain even greater degrees of compactness, safty in use, or convenience in use.

Such a device, which achieves the objectives indicated, and other objectives, is the device of the invention, which may be generally described as an elastic hosiery applicator, which in the preferred embodiment includes a sized circlet of round wire fitted with equidistantly spaced and descending "legs", each having an outwardly projected blunt tip.

It will be obvious to those skilled in the art, upon examination of the accompanying drawing and specification, that considerable variation of the preferred embodiment may be achieved without departing from the spirit of the invention, and without departing from the scope of the subjoined claims. Moreover, in the specification, certain terms have been used for brevity, clearness, and understanding; but no unnecessary limitations are to be implied therefrom beyond the requirements of prior art, if any such obtains, because such terms are used for descriptive purposes and are intended to be broadly construed. The specification and illustration of the invention is indicative and by way of example, and is not limited to only the exact details shown or described.

BRIEF DESCRIPTION OF THE DRAWING

A preferred embodiment of the invention—illustrative of the best mode in which the applicant has contemplated applying the principal—set forth in the following description and shown in the accompanying drawings, and is particularly and distinctly pointed out and set forth in the appended claims.

Similar numerals refer to similar parts through the drawing.

DESCRIPTION OF THE PREFERRED EMBODIMENT

Figure 1:
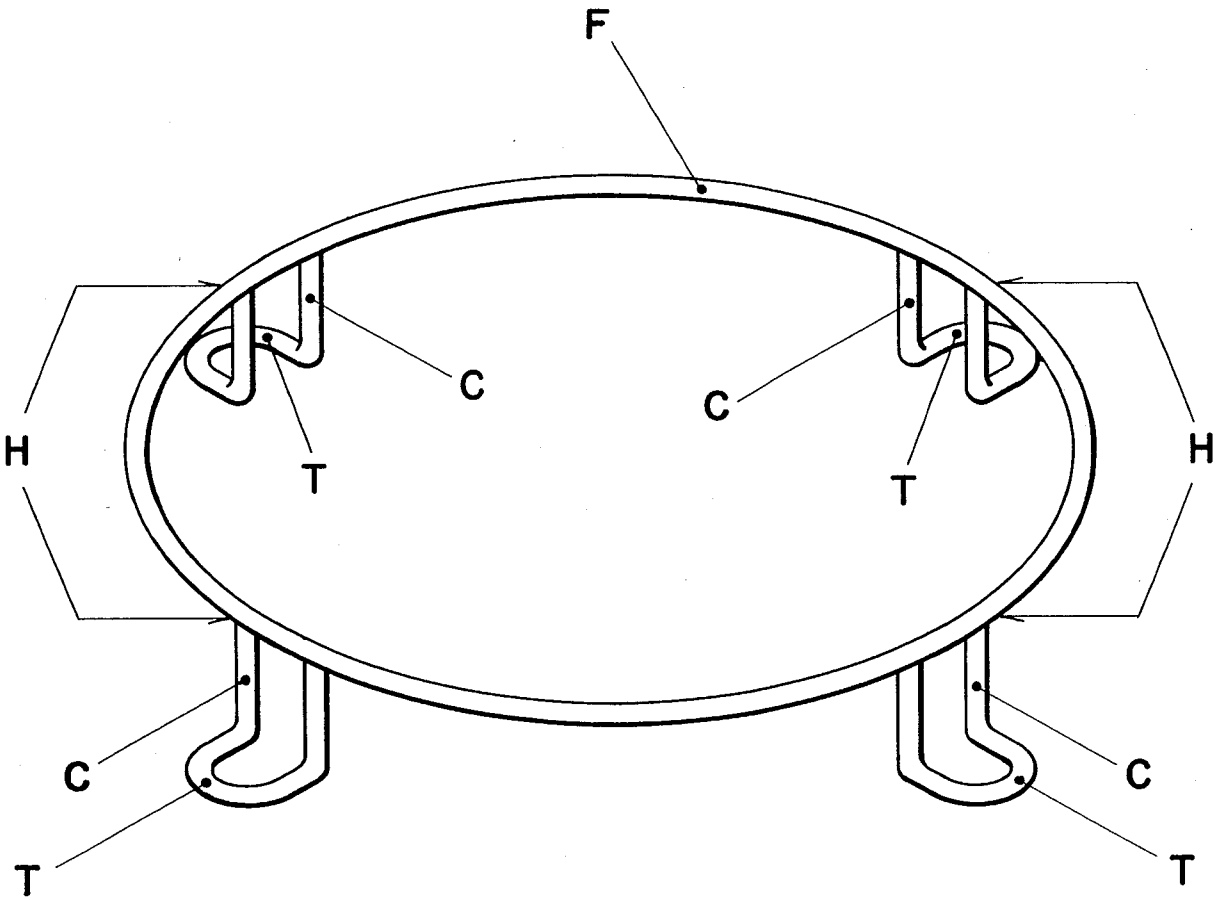
FIG. 1 is a perspective view of the preferred embodiment of the device of the invention.

The preferred embodiment of the device of the invention, as illustrated in FIG. 1 of the drawing, includes a circlet (F) which is preferably planar and continuously circular in shape, and which is preferably fabricated from metal wire such as brass or steel which is round in section. The circlet (F) has four equidistantly spaced "legs" (C) attached, each of which is preferably fabricated from a relatively narrow U-shape of metal wire material similar to that employed in the fabrication of the circlet (F). Each "leg" (C) is preferably oriented perpendicularly to the plane of the circlet (F), and is attatched thereto by welding or brazing or the like. A retainer tip (T) is formed on each "leg" (C) by outwardly bending, preferably perpendicularly, a terminal portion thereof. Portions of the circlet (F) between adjacent "legs" (C) constitute handles (H), and a non-destructive slippage finish (G), preferably chrome plating over smooth understructure, is provided preferably for the entirity of the device.

OPERATION OF THE PREFERRED EMBODIMENT

Figure 2:
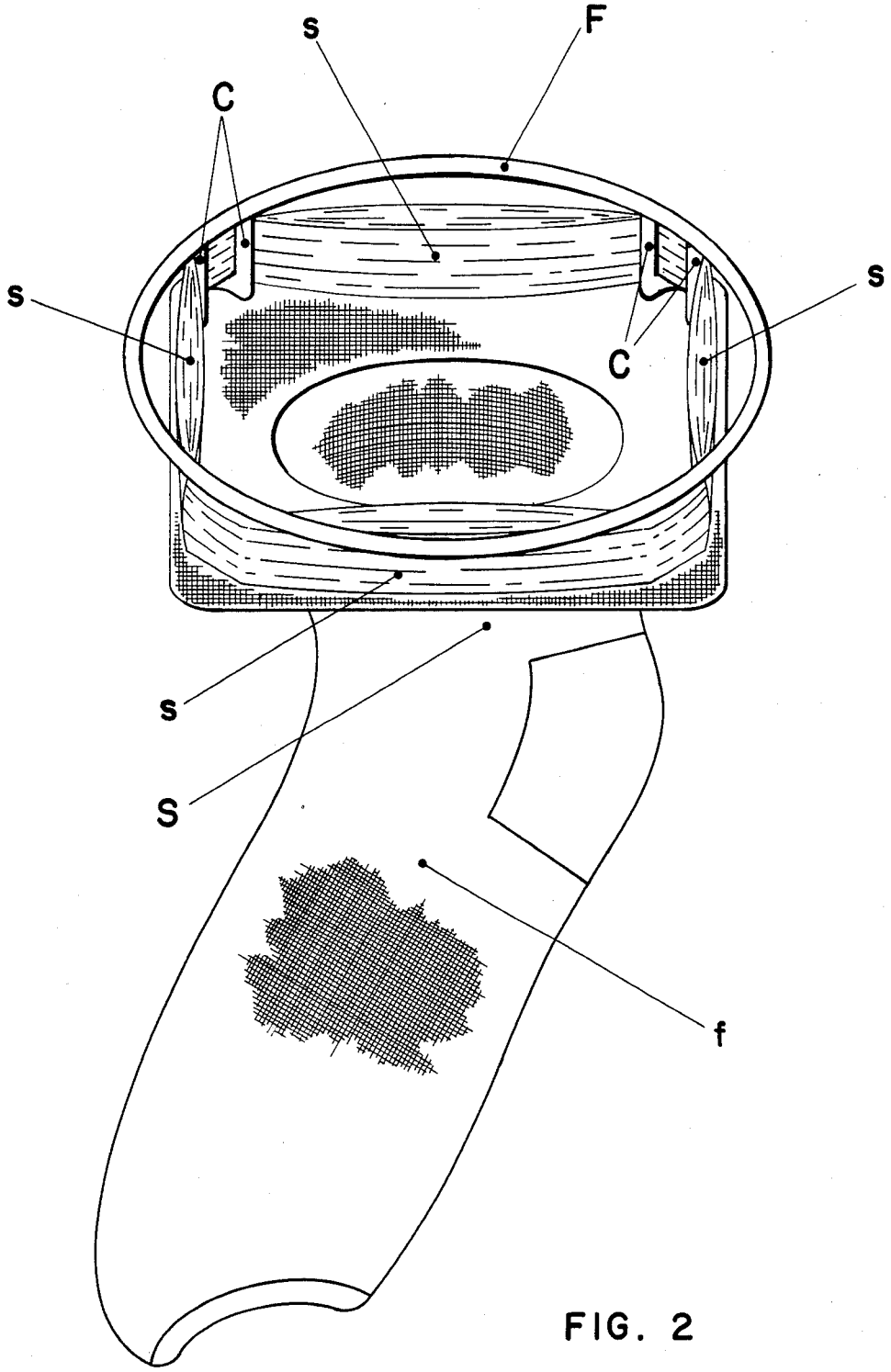
FIG. 2 is a perspective view of the preferred embodiment of the device of the invention which shows the manner in which the body of an elastic hose may be collected upon it prior to application upon the lower leg of a person.

The preferred embodiment of the device of the invention, as illustrated in FIG. 1 of the drawing, is used to facilitate the application of elastic hosiery upon the lower leg of a person. The body of the elastic hose (S) is first collected upon the "legs" (C) of the elastic hosiery applicator into a stable, dilate, and easily manipulatable configuration, such as that illustrated in FIG. 2 of the drawing. This is effected by first inserting the retainer tips (T) and collector "legs" (C) of the device into the top of the elastic hose (S). So doing will cause the top of the elastic hosiery (S) to be deformed into a dilate polygonal shape characteristic of the device of the invention, which, in the preferred embodiment, as illustrated in FIG. 2 of the drawing is a generally quadrangular shape. The aforementioned insertion is best accomplished by hooking a retainer tip (T) of a collector "leg" (C) into the top inch or so of the body of the elastic hose (S), and then using the fingers to stretch the opposite side of the elastic hose (S) over the opposite retainer tip (T) and collector "leg" (C) of the device and thereonto in like manner. The elastic hose (S) is then stretched sidewardly over and onto the remaining retainer tips (T) and collector "legs" (C) respectivly in turn.

Thereafter, the remainder of the body of the elastic hose (S) may be progressivly gathered upon the collector "legs" (C) of the device by a series of manual pleatings, wherein the fabric of the elastic hose (S) an inch or two below a given collector "leg" (C) is siezed in the fingers, and lifted over the retainer tip (T) of the collector "leg" (C) and allowed to contract elasticly into place thereupon.

Such pleatings, illustrated in (s) of FIG. 2 of the drawing, may be made successivly upon the collector "legs" (C) of the device in peripheral sequences, or sequences of opposite pairs of collector "legs" (C), and both the sequence and size of individual pleatings may be varied as desired to keep the elastic hose (S) centered upon the device. Because only a relativly small portion of the elastic hose (S) is manually stretched with each pleating, very little effort or strength is required to incrementally collect the entire body of the elastic hose (S) upon the applicator device. Such incremental pleating is not taxing to the limited hand strength of a handicapped person, nor does it engender repetition fatigue in the case of a person of normal hand strength, such as a health care worker. Also, the applicator device maintains the collected portion of the elastic hose (S) in a stable dilate configuration, continuing demands are not made upon hand strength merely to maintain such dilation, as has heretofore been the case. Thus it is possible to use either hand alternatly in the pleating process in order to make the best use of available hand strength, and to rest during the pleating process if desired.

Once the entire body of the elastic hose (S) has been so collected, roughly that portion of the elastic hosiery (S) which situates above the point of the human ankle, as is illustrated in FIG. 2 of the drawing, the applicator device may be rotated to orient the foot portion (f) of the elastic hose (S) properly to the human foot. Then, the human foot may be inserted through the circlet (F) and seated into the foot portion (f) of the elastic hose (S) without difficulty. Thereafter, the applicator device, held in the hands by the chosen handle portions (H) of the circlet (F) particularly indicated in FIG. 1 of the drawing, may be drawn up the length of the lower leg (L) of the person, causing the collected body of the elastic hose (S) to be paid out and smoothly deposited thereupon. This process is particularly illustrated at (A) of FIG. 3 of the drawing.

Figure 4:
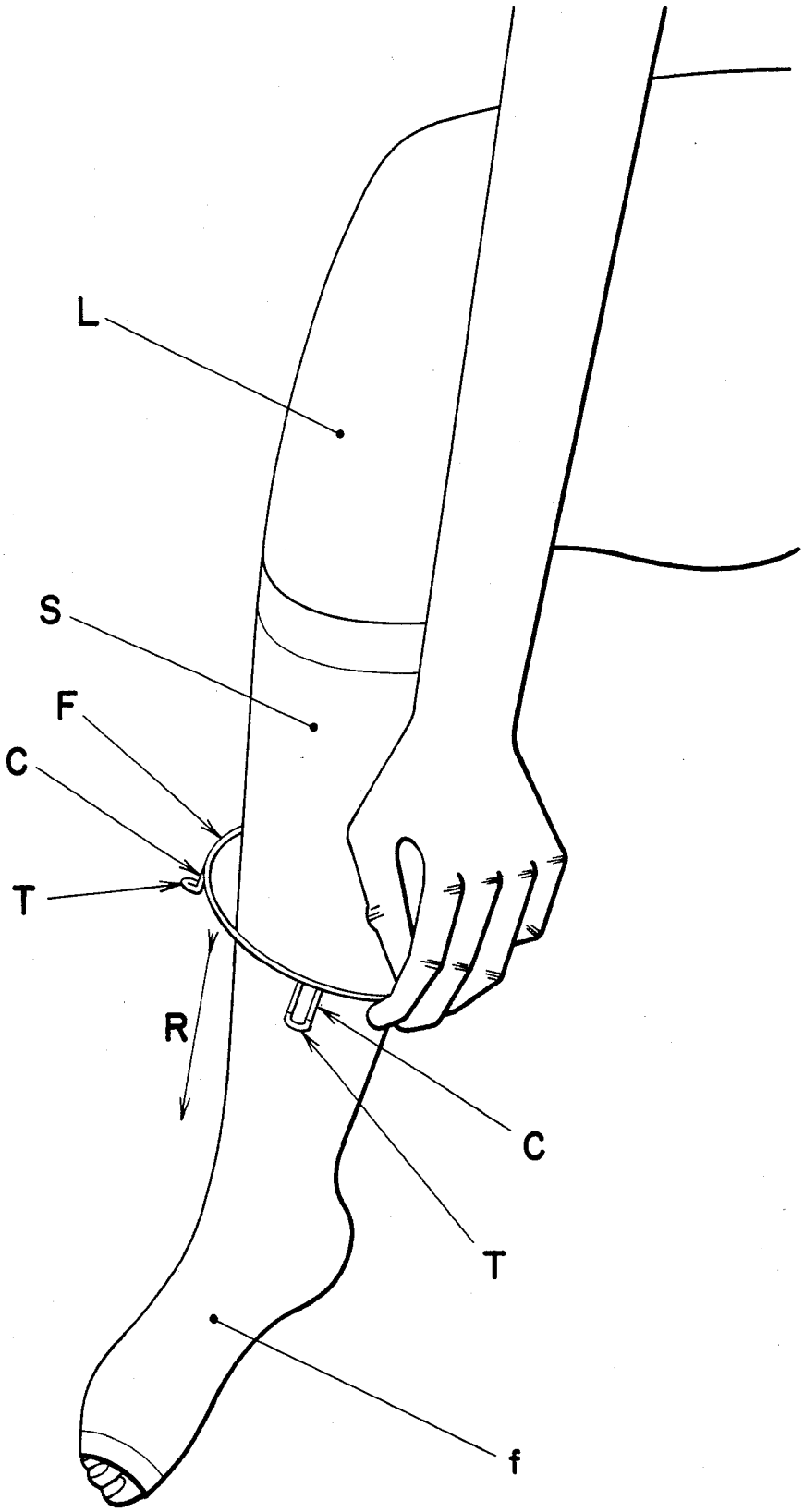
FIG. 4 is a perspective view of the preferred embodiment of the device of the invention which shows the manner in which the device may be removed from the lower leg of a person after the application of elastic hosiery thereto.

Thereafter, the applicator device may be removed from the lower leg (L) of the person by simple reverse passage over the applied elastic hose (S) in the manner indicated at (R) of FIG. 4 of the drawing.

Figure 3:
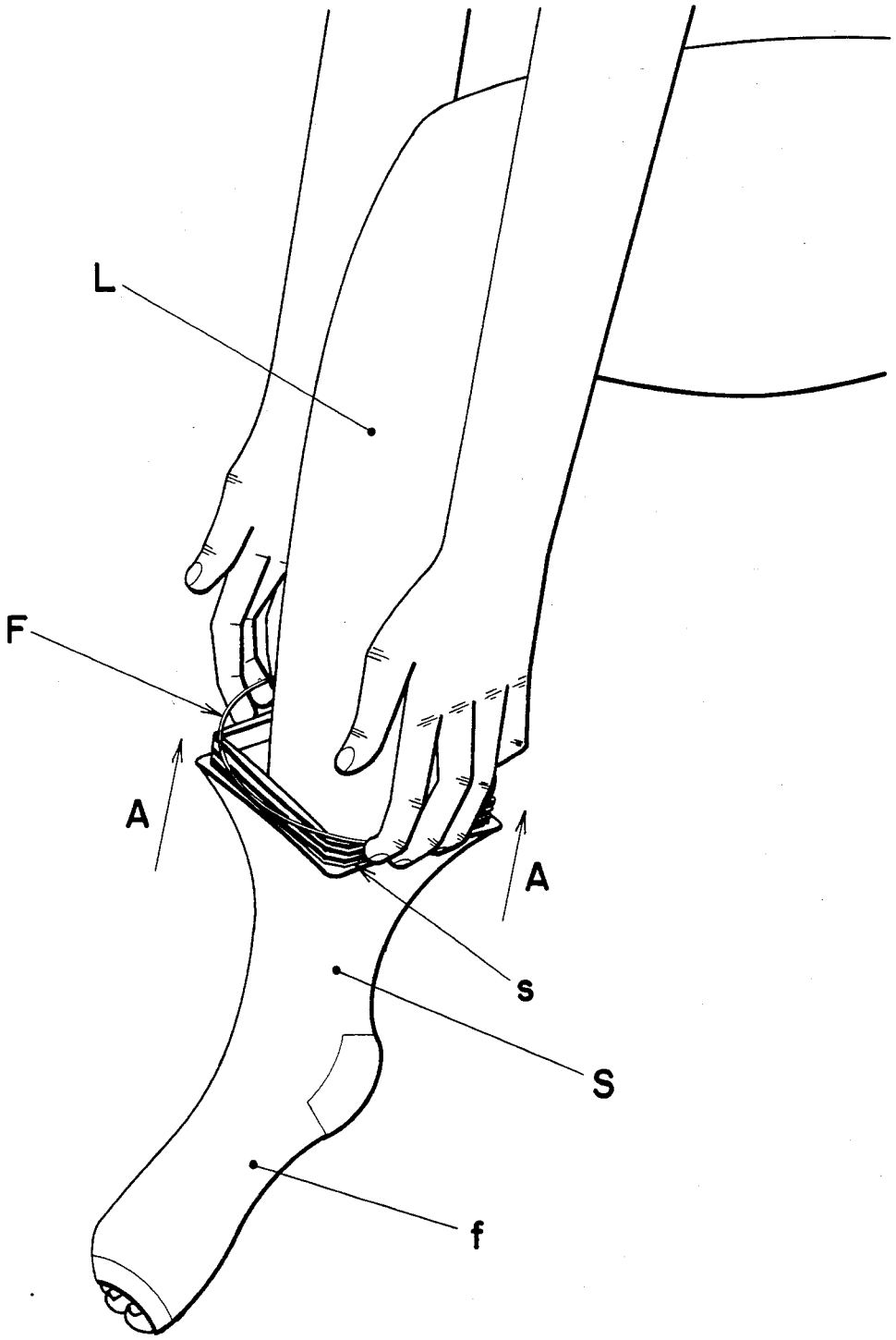
FIG. 3 is a perspective view of the preferred embodiment of the device of the invention in use, showing the manner in which the collected elastic hose may be applied to the lower leg of a person.
Figure 5:
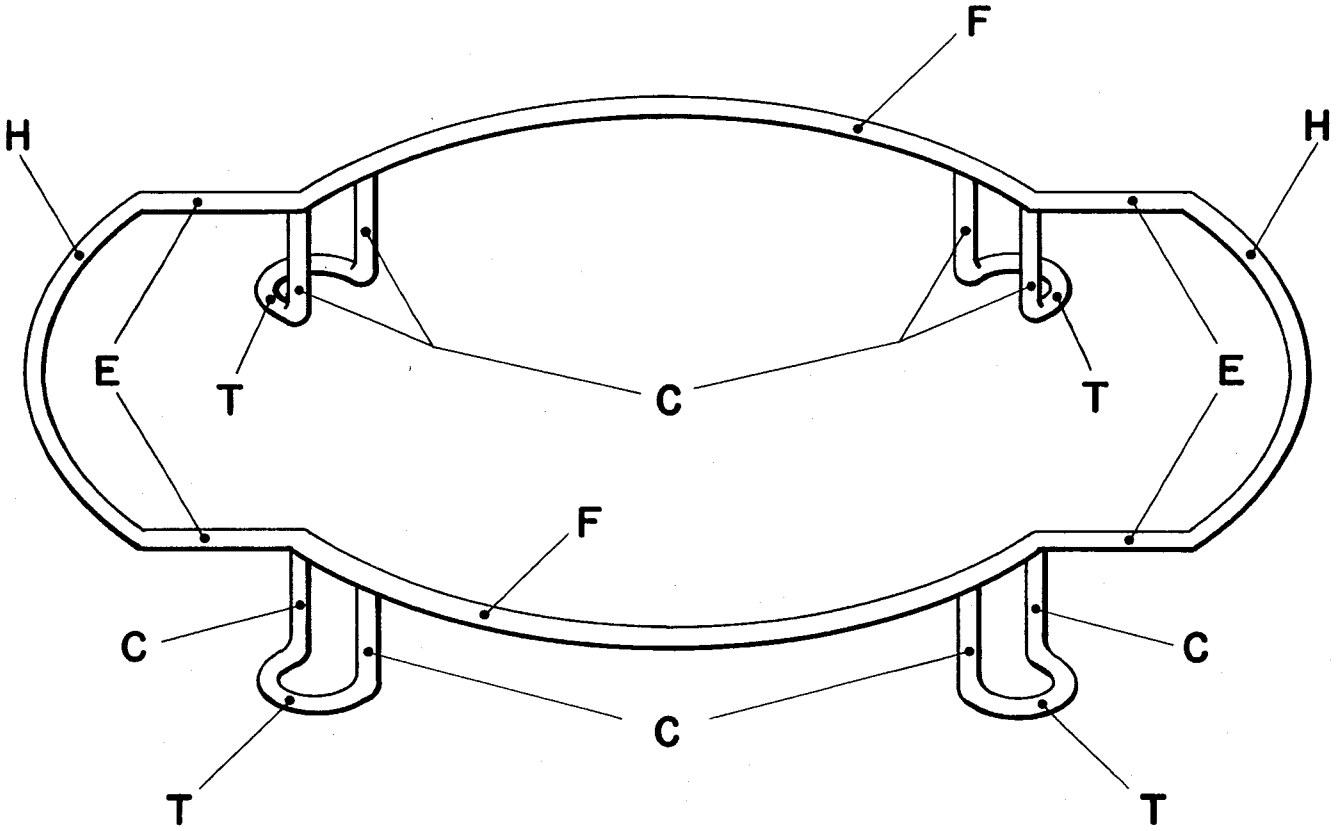
FIG. 5 is a perspective view of a variation of the device of the invention having laterally extended handle portions.
Figure 6:
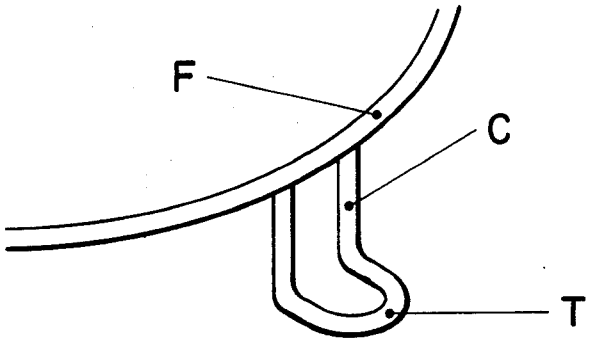
FIG. 6 is a perspective and detail view of the collector leg and retainer tip means of the preferred embodiment of the device of the invention.
Figure 12:
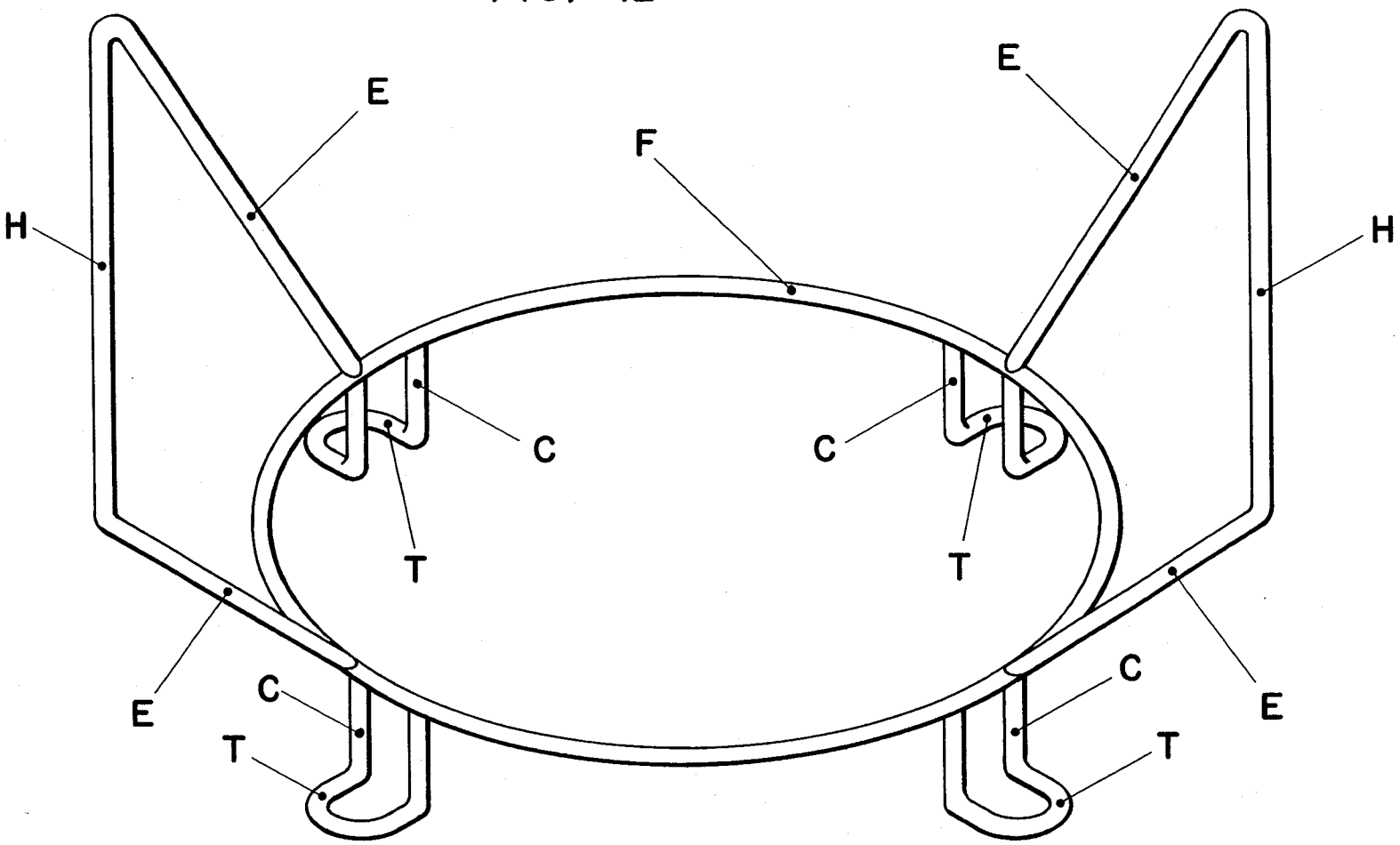
FIG. 12 is a perspective view of a variant of the device of the invention having generously extended and nonplanar handle portions especially suited for use by persons obese or having very limited body flexibility.

The described process of collection and application is relatively speedy and comparatively effortless, and owing to the reach-extending aspect of the diameter of the circlet (F), which is particularly evident in the case of the extended handle portions (H) of FIG. 5 and FIG. 12 of the drawing, requires but moderate body flexion. Due to the speed and simplicity with which the collected body of the elastic hose (S) may be paid out, as illustrated in FIG. 3 of the drawing, body flexion may be required only momentarily during the application process.

In the use of the device, two points of practice may be observed for best results. The collection of pleats should be made upon the collector "legs" (C) of the device, rather than accumulated upon the retainer tips (T) thereof. Also, the collection of pleats should be regular and in equalized increments to keep the body of the eastic hose (S) centered upon the device. Otherwise, some small slippage of pleats or wrinklages may occur during the application process.

The device may be used to assist the removal of emplaced elastic hosiery by approximatly reversing the application process. The empty device is passed up the lower leg (L) of the person, and the top few inches of the elastic hose (S) are pleated onto the collector "legs" (C) of the device. Then, with the elastic hose (S) thus secured to the device, the device is drawn back down the lower leg (L) of the person, reversing the elastic hose (S) in so doing, and drawing the reversed elastic hose (S) from the lower leg (L) of the person. In this process the reach-extending aspect of the diameter of the circlet (F) is combined with the increasing free length of the reversed elastic hose (S) in a most favorable manner, so that minimal body flexion is required or maintained. Also, the secure hand purchase afforded by the handle portions (H) of the circlet (F) greatly facilitates the manipulation of the emplaced elastic hose (S) during the removal process.

The device of the invention may also be used in the manner described by health care workers to apply elastic hosiery to the lower legs of their patients, including supine patients and patients who are unable to assist in the application process.

Because the application process is made relativly effortless with the use of the device of the invention, a single health care worker may apply several pairs of such hosiery in rapid succession, without experiencing the heretofore inevitable occurance of severe and progressive hand and arm fatigue. Such fatigue has, in the past, made the application of a second pair of elastic hosiery much more difficult and time consuming, while the application of a third pair of elastic hosiery would often not be practical without a period of rest on the part of the health care worker. Moreover, with the onset of severe hand and arm fatigue, the process of application would, heretofore, inevitably degenerate into an inefficient and effortful process of unprofessional appearance, the experience of which was often disturbing or distressing to the patient as well as to the health care worker.

With the use of the device of the invention, the application process may always be carried out with smooth and professional smartness. Also, as the application process is greatly speeded with the use of the device of the invention, a single health care worker is made more productive and efficient.

While an elastic hose may be collected upon the device of the invention in advance of application, and stored there for ready use, the maintanance of such dilation for an extended period of time would tend to weaken the elasticity of the hosiery material somewhat. Thus it is anticipated that the collection process would be performed by a health care worker in the presence of the patient just prior to actual application of the elastic hosiery. This would be an advantageous circumstance, as the brief period of collection time could also be used by the health care worker to observe the patient's condition, establish patient rapport, or just generally visit with the patient. Such activities have heretofore often received perfunctory attention due to the extreme difficulty of fitting elastic hosiery by prior methods.

The device of the invention may be used by a health care worker to fit elastic hosiery to the lower legs of a supine patient with relative ease. The elastic hose (S) may be collected upon the device as previously described, and oriented to the supine patient's foot. The circlet (F) may then be laid over the patient's foot while the health care worker seats the foot portion (f) of the elastic hose (S) thereupon. Thereafter, the circlet (F) being positioned vertically and aligned with the length of the patient's lower leg, the lower portion of the circlet (F) may be impressed into the mattress upon which the patient lies. As the circlet (F) is then traversed the length of the patient's lower leg, a local "traveling depression" will accompany and clearance the circlet (F) below the patient's lower leg (L). Thus the patient's leg will remain essentially undisturbed, without hyperextension of the knee or trauma to the skin surface. Also, as the circlet (F) spaces the knuckles of the health care worker, and the user generally, well away from the surface of the leg, local areas of soreness will not be abraded.

While the applicator device of the invention is simple in construction, and in the preferred embodiment employs no moving parts, the principal of the device is novel, and the physical structure of the device, in the preferred embodiment and certain variations thereof, incorporates numerous elements of advantage.

The plurality of "legs" (C) of the device, which constitute collector legs means (C) in more specific description, are arranged in a spaced array suitable to encircle the lower leg (L) of a human when such may be introduced thereinto. The said collector legs means (C) are maintained in the said spaced array during the use of the device by the circlet (F), which constitutes rigid perimeter frame means in more specific description, and which has a planar and continuously circular shape in the preferred embodiment in order tc minimise the amount of material incorporated thereinto, thus increasing the portability of the device while decreasing the manufacturing cost thereof. Additionally, the said shape of the circlet (F) offers a practical maximum of possible handle means portions (H) available to facilitate the manual manipulation of the device during use. It may be noted that the circular shape of the rigid perimeter frame means (C) eliminates the need to orient the hosiery (S) relative to the applicator device, as the human foot may be introduced into the applicator device at any degree of planar rotation of the circlet (F), and because handle means portions (H) thereof fall conveniently to hand at any such degree of planar rotation of the circlet (F). Thus the orientation of the hosiery (S) to the human foot may be effected after the hosiery (S) is collected upon the device, merely by rotation of the applicator device.

As the entirety of the circlet (F) comprises gripping portions such as the handle portions (H) particularly labeled in FIG. 1 of the drawing, the circlet (F) constitutes a ring-shaped handgrip element, in addition to comprising a rigid perimeter frame means (F) for disposing collector "legs" means (C) in spaced array.

The retainer tips (T) of the preferred embodiment, which constitute retainer tip means (T) in more specific description, are formed as illustrated in FIG. 1 of the drawing, merely by outwardly bending the terminal portion of each collector leg means (C), preferably perpendicularly. Each retainer tip means (T) functions as an obstructive protuberance, hindering the deployment of the elastic hosiery (S) from the collector legs means (C) of the device. By preventing the premature discharge of the hosiery (S) from the collector legs (C), the retainer tip means (T) facilitate the collection of the elastic hosiery (S) into the characteristic dilate configuration illustrated in FIG. 2 of the drawing. In further regularizing the discharge of the elastic hosiery (S) from the collector legs (C) of the device during the application process, the retainer tip means (T) facilitate the smooth and ordered application of the elastic hosiery (S) upon the lower leg (L) of the person.

While neither the size nor shape of such a retainer tip means (T) is especially critical, there is a common requirement among variations of retainer tip means (T) illustrated in FIG. 1, FIGS. 6–10, and 14, of the drawing, and other possible variations which might be fabricated in agreement with the principle, that such be sufficiently blunt as not to cut, snag, or run the fabric of the elastic hosiery (S); and sufficiently protuberant as to obstruct the discharge of the elastic hosiery material (S), without being so protuberant as to defeat the overall purpose of the applicator device.

The non-destructive slippage finish means of the device, which is preferably a chrome finish over smooth metal, and which extends over the collector legs means (C) and the retainer tip means (T) of the device, serves to optimise the application process by decreasing the amount of friction involved with the passage of the elastic hosiery material (S) over the retainer tip means (T) of the device, so decreasing the amount of pulling force which must be applied to the handle means portions (H) of the device in order to effect the completion of the application process previously described.

Where the non-destructive slippage finish means, which may be considered to cover the entirity of the preferred embodiment illustrated in FIG. 1 of the drawings, has a very low coefficient of friction, the retainer tip means (T) must be compensatory in having moderate obstructiveness. With a finish of slightly greater "drag", such as epoxy plastic or enamel paint, the retainer tip means would be scaled to be slightly less obstructive through a minor reduction in size.

On the whole, the non-destructive slippage finish incorporates elements of surface slippryness, bluntness of underlying structure, and smoothness of same; all of which three factors cooperate to permit the ordered discharge of the elastic hosiery material (S) over the retainer tip means (T) while not inducing the premature discharge of the elastic hosiery material (S) directely. The said elements may, within a reasonable range, be combined in various porportions to achieve the purpose of the device of the invention.

BROADENING PARAGRAPH

The preferred embodiment of the device of the invention, illustrated in FIG. 1 of the drawing, having an overall metal construction with chrome plated finish, is especially suitable for hospital use, in that it may be autoclaved without harm.

The device may be made in several size variations, which may be suited to the users of Small, Medium, Large, or Extra Large support hosiery generally, without particular requirement for size fitting to an individual person's lower leg.

For generally fitting a user of Medium size hosiery, a circlet (F) diameter of 5.25 inches is convenient. Special sizes could, of course, be stocked for persons of unusual leg porportion.

Referring to FIG. 5 of the drawing, the laterally extended handle means portions (H) set off by extender portions (E) of the circlet (F) permit slightly easier insertion of the human foot by alignment thereof with the longer dimension of the device, and slightly easier full-hand grasping of the device, which might prove desirable to persons of limited ankle flexibility or extreme hand disability, such as an advanced arthritic.

Figure 7:
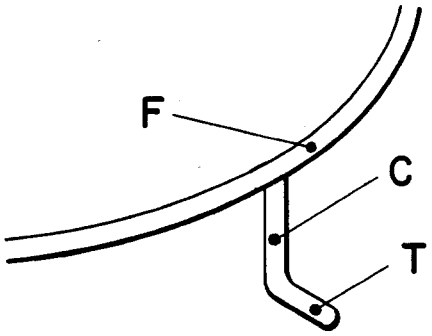
FIG. 7 is a perspective and detail view of a simple variation of collector leg and retainer tip means.

FIG. 7 of the drawing shows a possible simplified collector leg means (C) and retainer tip means (T) which might lower the manufacturing cost of the device slightly. In this variation, the device would be coated with a liquid vinyl plastic preparation by dipping, to produce the optimum non-destructive slippage finish for the embodiment.

Figure 8:
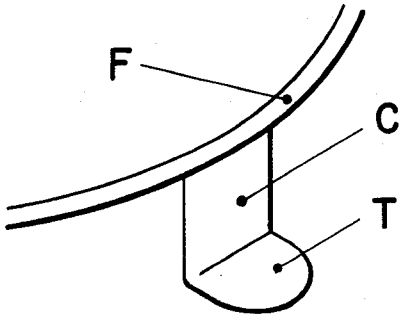
FIG. 8 is a perspective and detail view of a variation of collector leg and retainer tip means especially suited to the use of plastic in the manufacture of the device.

FIG. 8 of the drawing shows a variation of collector leg means (C) and retainer tip means (T) which would be especially well suited for a device made from plastic, such as a phenolic. As the texture of such a material could be readily controled, the non-destructive slippage finish could be achieved in the outer surface of the plastic material by the slight roughage of same in connexion with small retainer tip means (T), or the high polishing of the exterior surface in connexion with larger sized retainer tip means (T).

Figure 9:
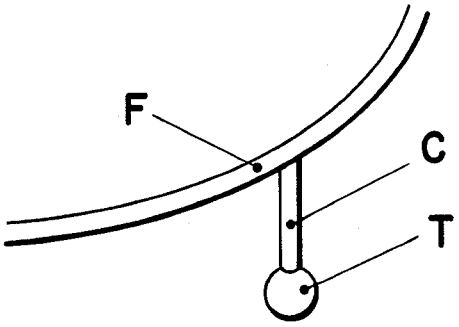
FIG. 9 is a perspective and detail view of a variation of collector leg and retainer tip means showing a plain globeular retainer tip means.

FIG. 9 of the drawing illustrates a simplified collector leg means (C) suited to the attachment of a molded, such as plastic, retainer tip means (T). The spherical shape of the retainer tip means (T) would make for more comfortable handling than the tip means (T) illustrated in FIG. 7 of the drawing.

Figure 10:
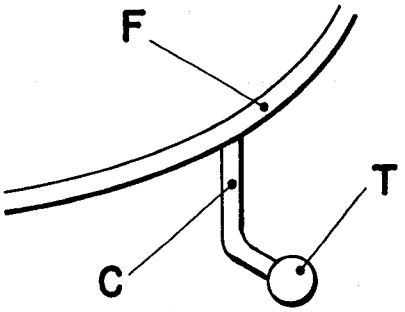
FIG. 10 is a perspective and detail view of a variation of collector leg and retainer tip means showing a laterally extended portion of collector leg means assistant to retainer tip means.

FIG. 10 of the drawing illustrates a bent collector leg means (C) which might prove useful with the larger sizes of elastic hosiery (S) wherein a relatively great amount of material might be collected thereupon. The retainer tip means (T) of FIG. 10 would gain in obstructivness from its position upon such a bent collector leg means (C).

Figure 11:
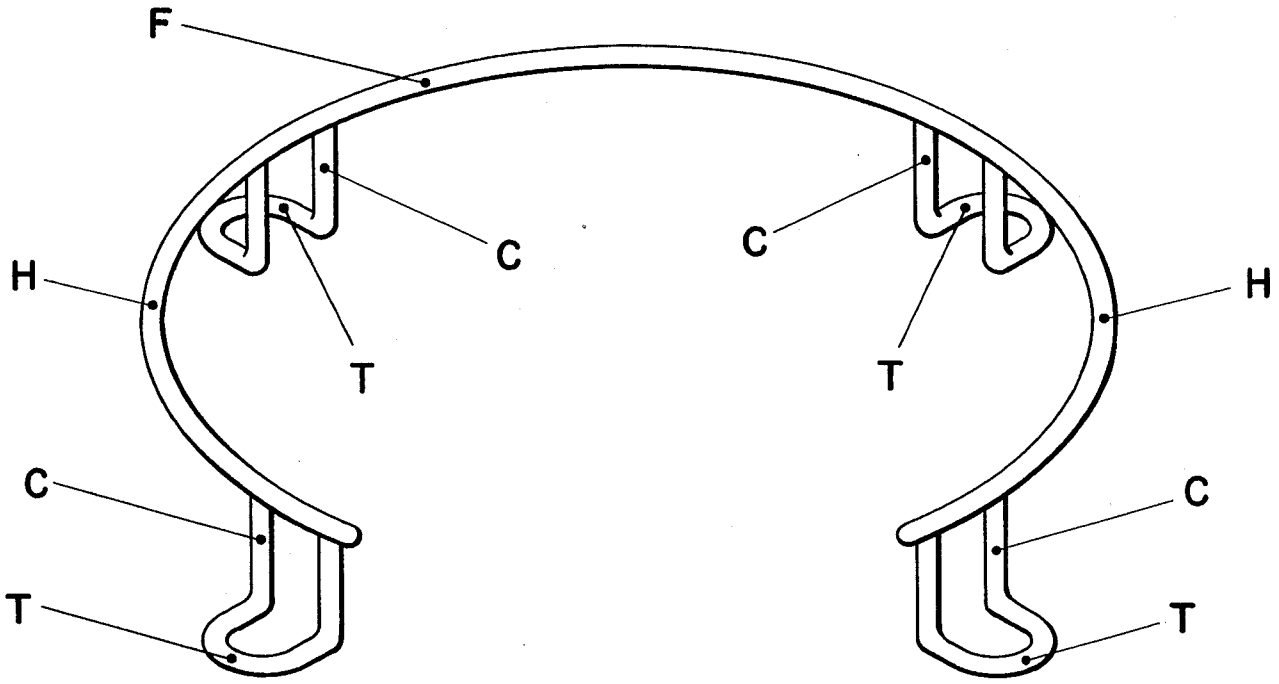
FIG. 11 is a perspective view of a variant of the device of the invention having a non-continuous circlet portion which is particularly suited to applying elastic hosiery to the lower legs of supine or bed-ridden persons.

FIG. 11 of the drawing illustrates a non-continuous circlet (F) which would facilitate the removal of the device from the ankle portion of the lower leg (L) of the user by lateral movement, minimising body flexion. Also, the device would be advantageous for use with supine persons, especially those upon a firm surface.

FIG. 12 of the drawing illustrates a non-planar projection of handle means portions (H) by inclined extender portions (E) which would amplify the reach-extending aspect of the circlet (F) considerably. This embodiment might prove advantageous for the use of an extremely obese individual, lacking in body flexibility almost entirely.

Figure 13:
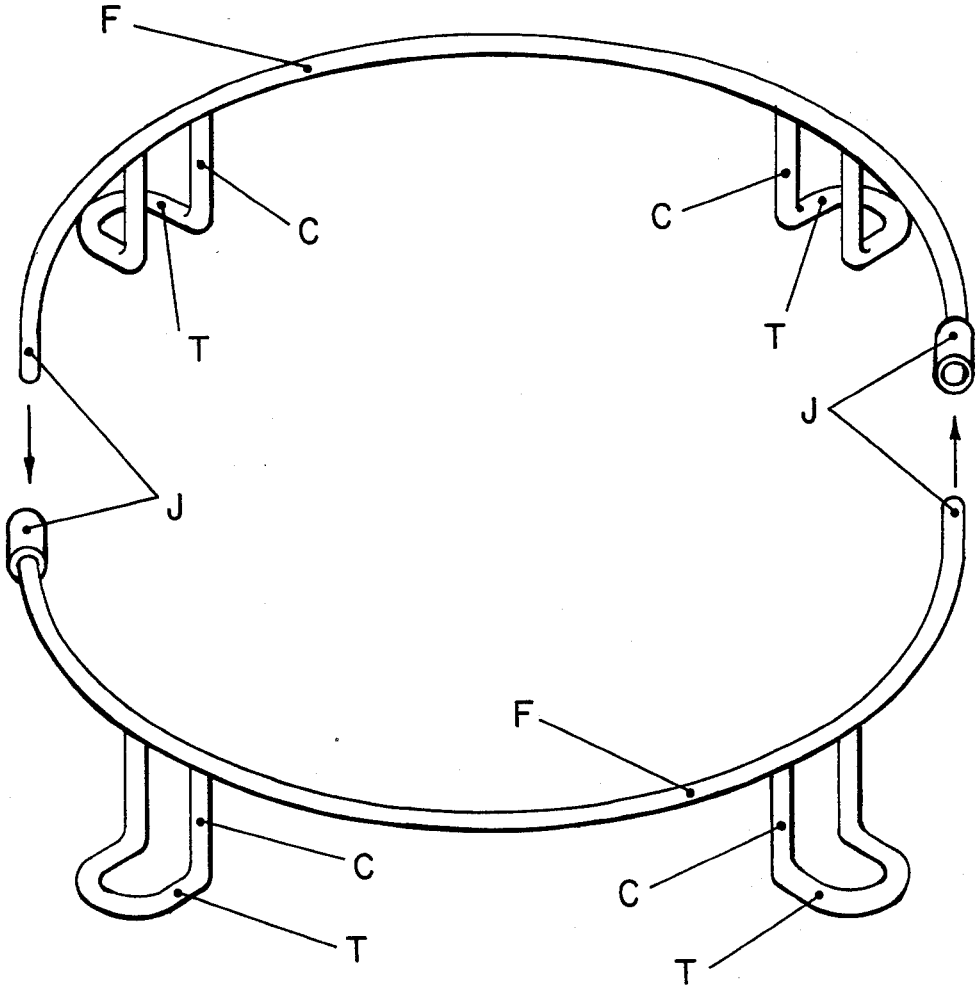
FIG. 13 is a perspective view of a variant of the device of the invention which shows a breakaway circlet portion comprised of identical halves, precluding the lodgement of the device upon the lower leg of a person, and achieving greater degree of compactness.

FIG. 13 of the drawing illustrates a breakaway circlet (F) having identical halves which join together by socketing at the joints (J). This device would permit compact packaging, and preclude the possibility of a user inadvertantly pulling the device above the knee into lodgement upon the upper leg, to the possible inconvenience of the user, or harm to leg circulation. In such a misuse, the person could simply pull the device apart and remove it at once. The device would also be most convenient in portage, and could be broken down and removed at calf level, rather than as illustrated in FIG. 4 of the drawing.

Figure 14:
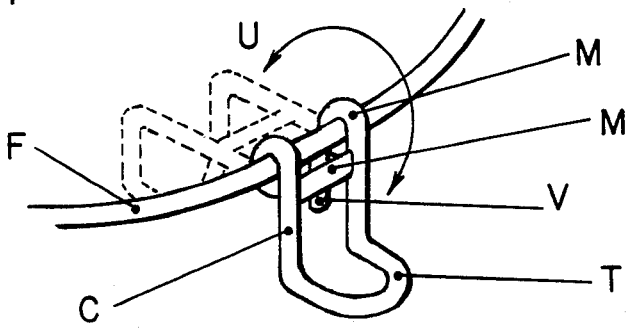
FIG. 14 is a perspective and detail view of a hinged type of collector leg means which obviates the use of welding to attatch collector legs to circlet means, and which achieves very shallow packaging or portage.

FIG. 14 of the drawing illustrates a hinge mechanism (M) whereby the collector leg means (C) is made collapsable. The collector leg means (C) would swing outward and upward to fold into the plane of the circlet (F), as indicated at (U) of FIG. 14. This would permit very shallow packaging and portage of the device. In use, the collector legs (C) would be turned back down and would attain the normal descending attitude, maintaining same by abuting against a stop (V) of the circlet (F) under the contracting forces imposed by the elastic hosiery (S) being collected upon the device.

Combined with the breakaway circlet (F) of FIG. 13, the device would be most safe in use and convenient in portage, and would be well adapted to non-hospital use.

It may be noted that while the device is intended primarily for use with support hosiery or anti-embolism stockings of the sort normally prescribed by physicians, the device would work quite well with ordinary nylon stockings, and that many persons having moderate hand disabilities may find the device convenient, though not mandatory, in such usage.

While the device may function with two, three, or five or more collector legs (C), four such has been found to be the optimum number for general usefullness.

The circlet (F) must be sufficiently rigid to resist the contractive force of the collected elastic hose (S) applied against the collector legs (C). This is especially true of the embodiments of FIGS. 11 and 13, and of the joints (J) thereof.

I claim:

1. A device for facilitating the application of elastic hosiery upon the lower leg of a person without taxing hand strength, including:

a rigid perimeter frame means sized to encircle the said lower leg of a person and preferably planar and circular in shape, said frame means affording a plurality of graspable portions at various stages of planar rotation, means whereby said elastic hosiery, collected upon said device without specific orientation thereto, may be oriented to the said lower leg of a person upon the planar rotation of said device, and a plurality of descending collector leg means extending from said frame means substantially normal to the plane thereof and in spaced array, upon which said collector leg means said elastic hosiery may be collected in incremental pleatings without taxation of hand strength, and retainer tip means upon a lower portion of said collector leg means and comprising an obstructive protuberance hindering the premature deployment of said elastic hosiery from collection upon said collector leg means, with said device having a non-destructive exterior finish sufficiently smooth and blunt in character as to preclude snagging, running, or otherwise damaging the said elastic hosiery during the use of the said device.

2. The device of claim 1, including:

frame means reversably separable into a plurality of portions, preferably by means of socket-type joints, means whereby the said device may be laterally removed from the lower leg of a person, and means whereby said device may be made more compact in storage.

3. The device of claim 1, including:

frame means comprising a discontinuous circlet, means whereby the application of elastic hosiery upon the lower leg of a supine person may be facilitated, and means whereby the lateral removal of said device therefrom may be achieved.

4. The device of claim 1, including:

collector leg means and retainer tip means integrally formed from wire material in a relatively narrow U-shape, attatched at the open ends thereof to frame means and descending from said frame means, and having a lower portion of said U-shape outwardly projected as by bending.

5. The device of claim 1, including:

hinged collector leg means reversably foldable for shallow packaging or storage of said device, preferably with said collector leg means folding outwardly and upwardly from the frame of said device, and into the interior plane thereof, and abuting in unfoldment against stop means upon said frame means.

* * * * *